US005644825A

United States Patent [19]

Threlkeld et al.

[11] Patent Number: 5,644,825

[45] Date of Patent: Jul. 8, 1997

[54] METHOD AND APPARATUS FOR INCREASING THE YIELD OF RUBBER YARN

[76] Inventors: James O. Threlkeld; Thor Robert Thisse, both of 4100 Barringer Dr., Charlotte, N.C. 28217

[21] Appl. No.: 614,747

[22] Filed: Mar. 13, 1996

[51] Int. Cl.[6] ..... D02J 1/22

[52] U.S. Cl. ..... 28/240

[58] Field of Search ..... 28/172.2, 220, 28/240, 241, 242, 243, 245; 57/309, 310, 287, 288; 264/288.4, 289.3, 290.5

[56] References Cited

U.S. PATENT DOCUMENTS 2,956,330 10/1960 Pitzl .
3,671,623 6/1972 Fukushima et al. ..... 28/288.8
4,961,307 10/1990 Cook .
5,229,060 7/1993 Knox et al. ..... 28/172.2
5,259,098 11/1993 Gupta ..... 28/240
5,261,023 11/1993 Darsey .
5,365,729 11/1994 Phillips et al. ..... 28/240
5,413,023 5/1995 Babel et al. .

*Primary Examiner*—C. D. Crowder
*Assistant Examiner*—Larry D. Worrell, Jr.
*Attorney, Agent, or Firm*—Shefte, Pinckney & Sawyer

[57] ABSTRACT

A method and apparatus for stabilizing and increasing the yield of natural rubber yarn includes stretching the yarn three times while allowing the yarn to relax intermediate and following the stretching steps. The method is accomplished using a plurality of nip rolls wherein a second roll is caused to travel faster than a first roll or the second roll is larger than the first roll, or both, to achieve the stretch while the yarn is relaxed intermediate three such stretching assemblies.

27 Claims, 3 Drawing Sheets

METHOD AND APPARATUS FOR INCREASING THE YIELD OF RUBBER YARN

BACKGROUND OF THE INVENTION

The present invention relates broadly to methods and apparatus for yarn preparation by mechanical deformation and, more particularly, to a method and apparatus increasing the yield of rubber yarn for by stretching prior to winding.

Natural rubber yarn, in the form of strands, is incorporated into various textile base yarns to increase the stretchability thereof. Incorporation of a natural rubber yarn into a loose knit or weave can provide the resulting fabric with the ability to return to its original configuration after being stretched. One of the problems with natural rubber yarn is its tendency to after stretching. That is, after a number of stretch and relax cycles, the rubber yarn increases, the yarn elongates and it no longer returns to its original form. This inherent, troublesome characteristic makes working with natural rubber yarn difficult. The yarn must be prestretched prior to use or the resultant fabric will have less than ideal stretching characteristics.

It has been empirically determined that natural rubber yarn will achieve a stability with respect to plastic deformation after three stretches. For a continuous, traveling strand, the effect is pronounced over whatever segment of natural rubber yarn is stretched. This stretching acts to break weaker bonds within the rubber which would be broken in any event under use. Therefore, if rubber yarn can be stretched and allowed to relax three times prior to use, the yarn would be much more stable and would provide a better finished product.

Accordingly, there exists a need for a method and apparatus to prestretch rubber yarn prior to use, and, preferably, relatively early in the fabric manufacturing process.

SUMMARY OF THE INVENTION

It is accordingly an object of the present invention to mechanically deform rubber yarn for a plurality cycles prior to winding.

It is another object of the present invention to mechanically deform the rubber yarn by stretching and releasing the yarn at least twice, preferably three times.

It is yet another object of the present invention to accomplish the stretching and relaxation prior to winding the yarn on a bobbin.

To that end, a method for stabilizing and increasing the yield of natural rubber yarn prior to winding the yarn on a bobbin includes the steps of providing a traveling strand of natural rubber yarn for winding on a bobbin; providing an assembly for winding the strand on a bobbin; providing a first assembly for stretching the yarn with the first stretching assembly being associated with the winder; providing a second assembly for stretching the yarn with the second stretching assembly spaced a predetermined distance from the first stretching assembly with a space therebetween defining a first yarn relaxation region with a space between the second yarn stretching assembly and the winder defining a second yarn relaxation region; stretching the traveling yarn using the first stretching assembly; relaxing the yarn in the first relaxation region; stretching the yarn a second time using the second stretching assembly; relaxing the yarn in the second relaxation region and winding the yarn on a bobbin using the winder. It is preferred that the method of the present invention include the steps of providing a third assembly for stretching the yarn with third stretching assembly being disposed intermediate the second stretching assembly and the winder and being spaced a predetermined distance from the second stretching assembly with the space therebetween defining the second relaxation region and a space between the third stretching assembly and the winder defining a third relaxation region. The method preferably further includes the steps of stretching the yarn using the third stretching assembly and relaxing the yarn in the third relaxation region.

It is additionally preferred that the step of providing the first stretching assembly includes providing a plurality of rolls forming two nips with the yarn directed to pass between the nips and the step of stretching the yarn a first time includes passing the yarn between the nips.

Preferably, the step of providing the plurality of rolls includes providing two yarn drive rolls formed with diameters different from one another with one yarn drive roll being used to form one of said two nips in the other yarn drive roll being used to form the other of the two nips so that yarn passing through one of the nips travels faster than yarn traveling through the other of the two nips. It is further preferred that the step of providing the first stretching assembly includes providing a plurality of rolls with at least two rolls being yarn drive rolls and the other of the rolls being disposed for selective contact with the yarn drive rolls to form at least two nips therebetween with the first stretching assembly further including an assembly for driving each of the yarn drive rolls at a different speed than the other of the yarn drive rolls so that the yarn passing through one of the nips travels faster than yarn passing through the other of the nips.

Preferably, the step of providing the second stretching assembly includes providing a plurality of rolls forming two nips with the yarn directed to pass between the nips and the step of stretching the yarn a second time includes passing the yarn between the nips. It is further preferred that the step of providing a plurality of rolls for the second stretching assembly includes providing two yarn drive rolls formed with diameters different from one another with one yarn drive roll being used to form one of the two nips and the other yarn drive roll being used to form the other of the two nips so that yarn passing through one of the nips travels faster than yarn traveling through the other of the two nips.

The step of providing the second stretching assembly preferentially includes providing a plurality of rolls with at least two rolls being yarn drive rolls and the other of the rolls being disposed for selective contact with the yarn drive rolls to form at least two nips therebetween with the second stretching assembly further including an assembly for driving each of the yarn drive rolls at a different speed than the other of the yarn drive rolls so that yarn passing through one of the nips travels faster than yarn passing through the other of the nips. It is further preferred that the second stretching assembly also include means for driving each of the yarn drive rolls at a different speed than the other of the yarn drive rolls so that yarn passing through one of the nips travels faster than yarn passing through the other of the nips. The third stretching assembly is formed in a manner similar to the first and second stretching assemblies, described above.

According to the preferred embodiment of the apparatus of the present invention, the apparatus includes an assembly for winding the strand on a bobbin, a first assembly for stretching the yarn with the first stretching assembly being associated with the winder and a second assembly for stretching the yard with a second stretching assembly spaced a predetermined distance from the first stretching assembly with a space therebetween defining a first yarn relaxation region with a space downstream of the second stretching assembly defining a second relaxation region.

It is preferred that the present invention include a third yarn stretching assembly disposed intermediate the second stretching assembly and the winder and being spaced a predetermined distance from the second stretching assembly with a space therebetween defining a second relaxation region and a space between the third stretching assembly and the winder defining a third relaxation region. The first, second and third yarn stretching assemblies are constructed as above described.

By the above, the present invention provides an apparatus for automatically stretching rubber yarn at least twice and preferably three times conveniently on a winder as the yarn is being wound. Therefore, yarn packages of natural rubber yarn can be delivered in a state ready for use.

DETAILED DESCRIPTION OF THE PREFERRED EMBODIMENT

Figure 1:
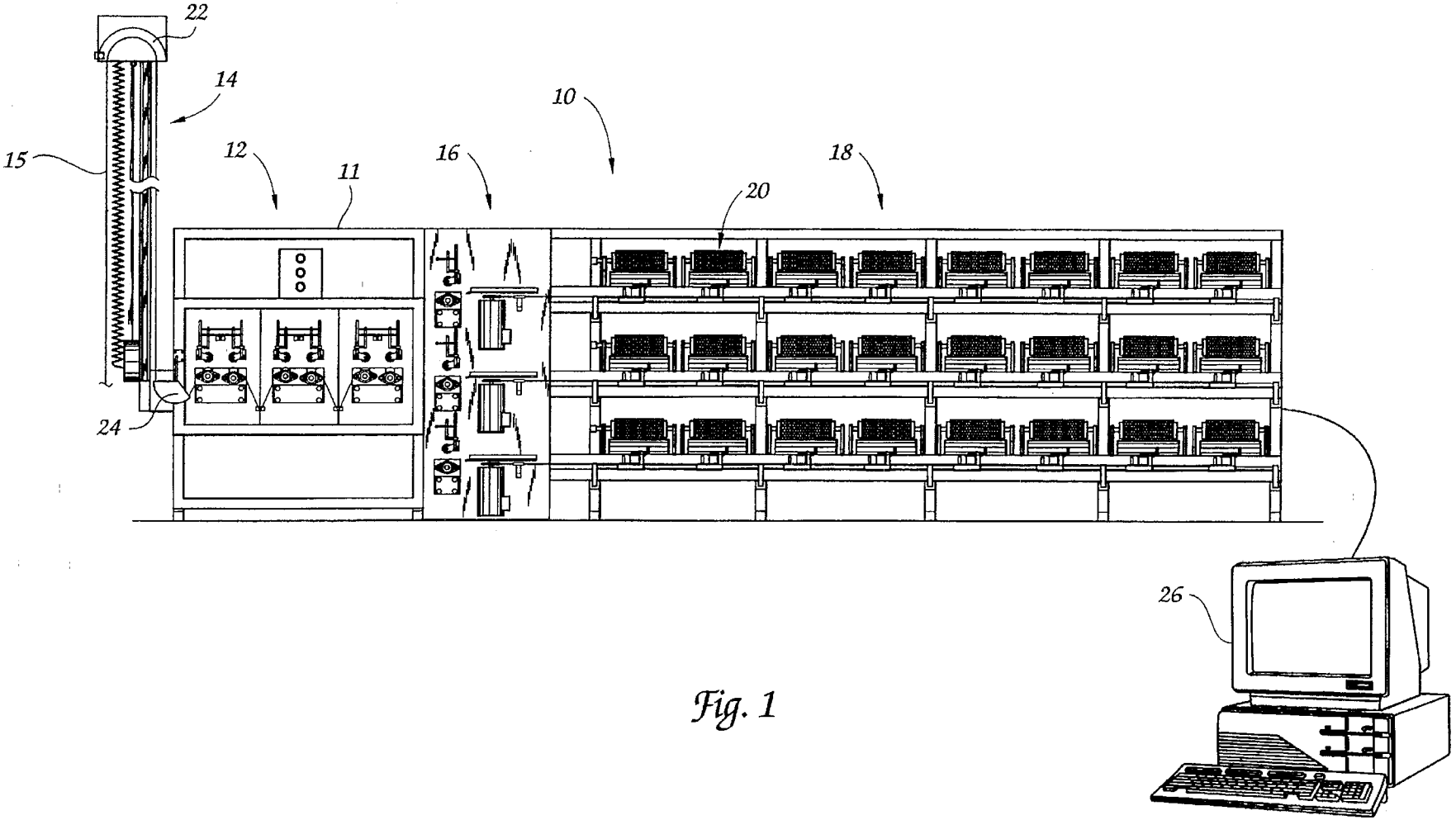
FIG. 1 is an elevational view of a rubber yarn winder associated with the preferred embodiment of the present invention.

Turning now to the drawings and, more particularly, to FIG. 1, a rubber yarn winder is illustrated generally at 10 and is constructed on a skeletal, floor-standing frame structure 11. Beginning at a yarn source 11, and continuing downstream with respect to yarn travel, a yarn support 14 is included for removal of entanglements from a traveling strand 15 and is formed as a vertically oriented support member having a pneumatic bearing 22 mounted to the distal end thereof and a second pneumatic bearing 24 mounted to the skeletal frame 11 below the support 14. Continuing downstream in the direction of yarn travel, the stretching assembly of the present invention is illustrated generally at 12 and will be explained in greater detail hereinafter. After the stretching assembly 12, a yarn delivery assembly 16 is provided and includes a plurality of rolls 17 for further propulsion and distribution of the yarn 15 to a bank 18 of traverse package winders 20. The yarn itself is formed as a generally flat elongate tape formed from a plurality of individual yarn strands fused together after extrusion. The yarn strands are reseparated during the winding process and individual yarn strands 15' are wound onto yarn packages by the traverse assemblies 20.

A control assembly 26, which may be a microcomputer, is provided for overseeing the on-going winding operations and the relative speeds of yarn travel imposed by the various rolls and traverse assemblies throughout the winder 10. The foregoing is intended to provide a general overview of an assembly for package winding natural rubber yarn as will be appreciated by those skilled in the art and is not intended to provide a detailed description of every aspect of winding.

Figure 2:
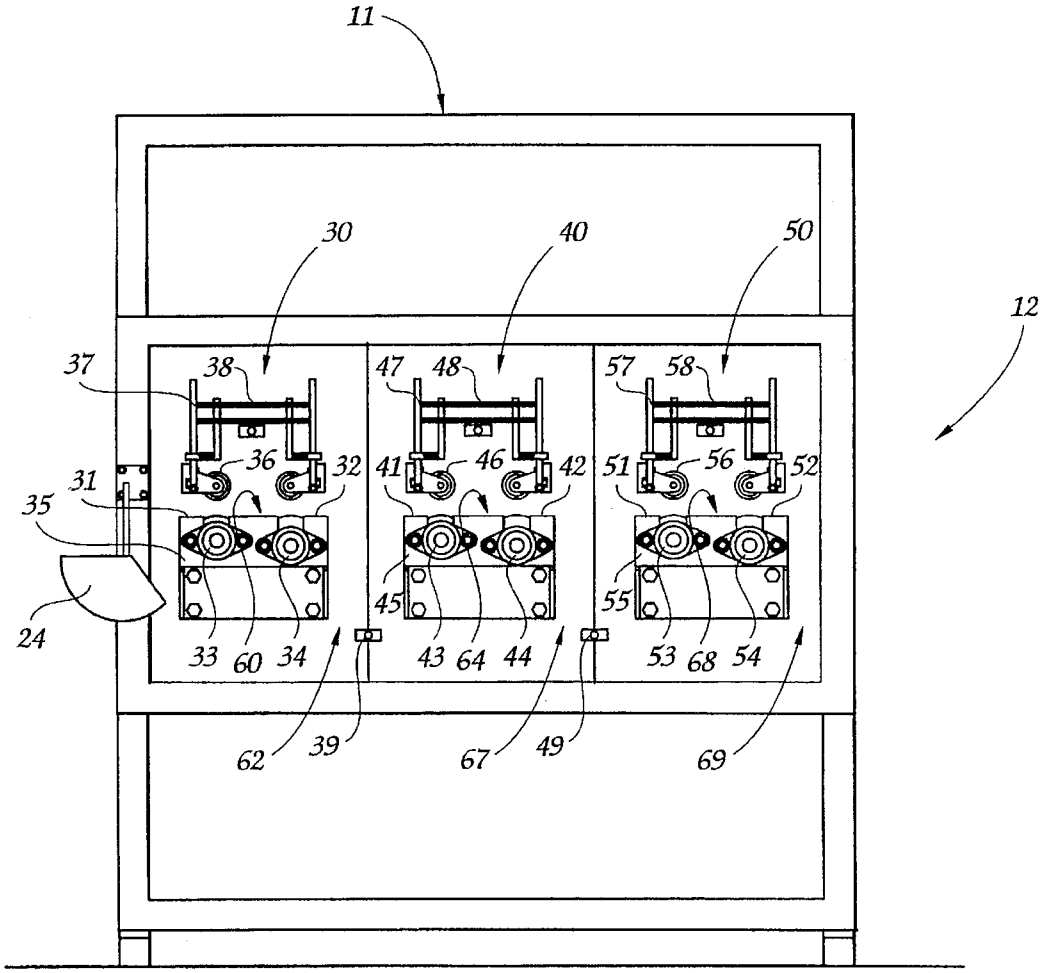
FIG. 2 is an elevational view of a yarn stretching assembly according to the preferred embodiment of the present invention, shown detached from the winder for clarity.

Turning now to FIG. 2, the overall yarn stretching assembly 12 is illustrated in a manner disembodied from the rest of the winder 10. Nevertheless, it should be understood that the stretching assembly 12 illustrated in FIG. 2 is not necessarily a free-standing structure. It should also be understood that the basic components of the stretching assembly 12 according to the present invention may be manifest in various separate forms and should not be considered limited to the present assembly acting in concert with a winder 10.

The stretching assembly 12 is shown mounted to the skeletal frame 11 and consists of three individual stretching units 30,40,50. Each stretching unit is essentially the same except for the diameter, speed or both, of the rolls as will be discussed in greater detail hereinafter.

Looking at the first stretching assembly 30, two yarn drive rolls 31,32 are mounted to the frame in generally parallel alignment using a bracket 35. The drive rolls 31,32 are driven by electric motors 33,34 respectively. Support rolls 36 are mounted above the drive rolls 31,32 and are pivotally mounted to the frame 11 using levers 37 separated by springs 38. This assembly allows the operator to snap both support rolls 36 into nip forming engagement with the drive rolls 31,32 using the levers 37. As will be appreciated in greater detail hereinafter, the drive rolls 31,32 are each formed with a different diameter and the motors 33,34 are each configured for individual speed control operation as administered by the control assembly 26

The second stretching assembly 40 includes similar drive rolls 41,42 which are mounted to the frame using a bracket 45 and are engaged by electric motors 43,44 for driving movement thereof. The second stretching assembly 40 is disposed downstream of the first stretching assembly 30. A yarn guide peg 39 is mounted intermediate the two stretching assemblies 30,34 to guide the yarn through the relaxation region as will be demonstrated in greater detail presently. A similar arrangement is provided for the third yarn stretching assembly 50. There, dissimilar drive rolls 51,52 are mounted to the frame 11 using a bracket 55 and are engaged by electric motors 53,54. Support rolls 56 are pivotally mounted to the frame using a lever assembly 57 joined by a spring 58, thereby completing the third yarn stretching assembly 50. As was previously stated, the yarn typically begins winding operation as a fused tape of individual yarn strands and, in order to split the yarn into individual strands for winding on the traverse assembly seen in FIG. 1, a comb is provided within the yarn path. It may be appreciated by those skilled in the art that the stretching can take equal effect regardless of where the yarn is stretched.

As was previously discussed, the yarn travels through six separate regions within the stretching assembly 12. The region between the first drive roll 31 and the second drive 32 defines a first yarn stretching region 60. The region between the first stretching assembly 30 and the second stretching assembly 40 defines a first yarn relaxation region 62. The space between the second stretching assembly drive rolls 41,42 defines the second stretching region while the area intermediate the second stretching assembly 40 and the third stretching assembly 50 defines the second yarn relaxation region. As may be expected, the area intermediate the third stretching assembly drive rolls 51,52 defines the third stretching region and the area downstream of the third stretching assembly 50 defines the third yarn relaxation region. As the yarn transits the stretching assembly 12, it is worked thereby and is directed to the traversing assemblies have experienced the necessary three stretches to prepare the yarn for winding in a useful manner.

Figure 3:
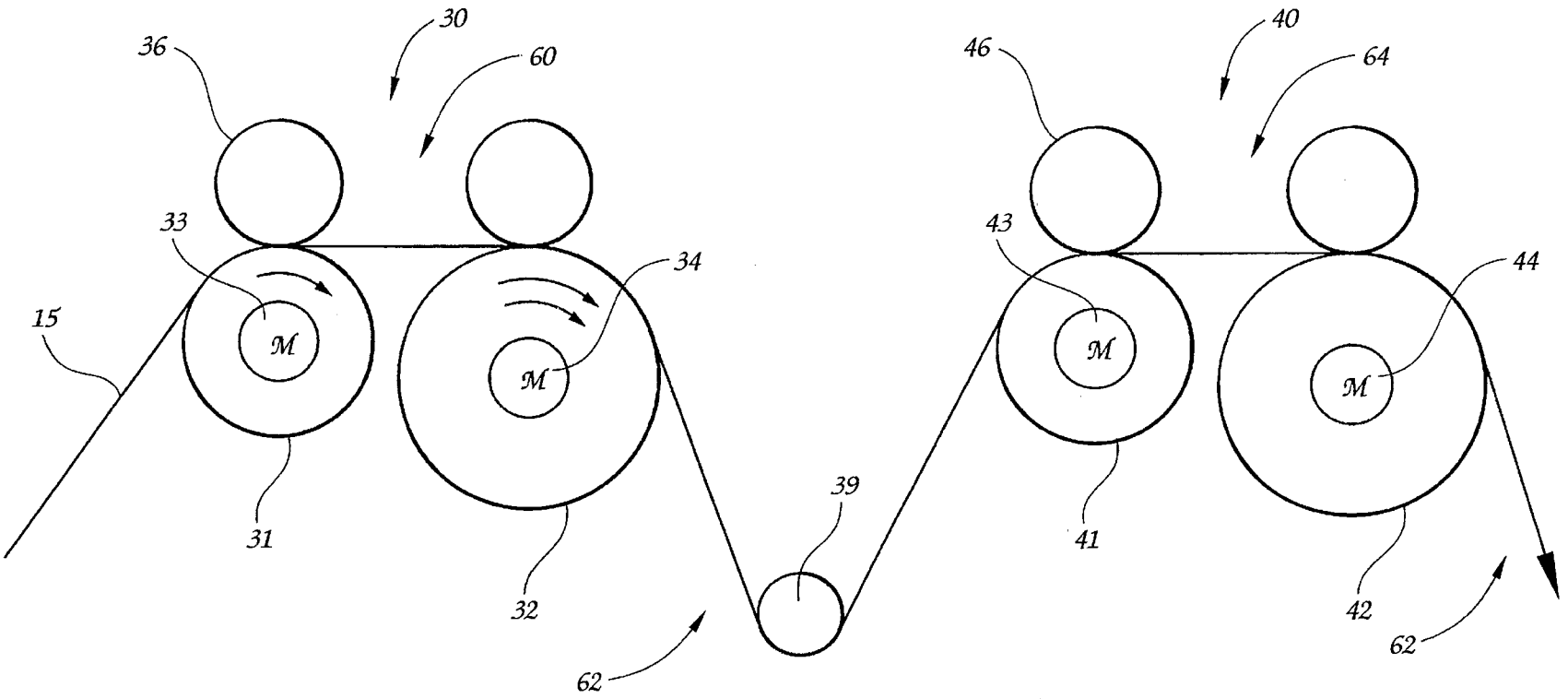
FIG. 3 is a diagrammatic view illustrating the method of stretching the rubber yarn according to the preferred embodiment of the present invention.

Turning now to FIG. 3, a diagrammatic sketch of the first and second stretching assemblies 30,40 is illustrated. Basically, there are two ways to control the stretching of the yarn 15 according to the present invention. First, and as is evident from FIG. 3, the second drive rolls 32,42 are larger than the first drive rolls 31,41. Optionally, the second drive rolls 32,42 may be driven faster than the first drive rolls 31,41 as indicated by dual arrows on the second drive rolls 32,42 and single arrows on the first drive rolls 31,41. Therefore, the yarn may be stretched in the region between the first and second drive rolls 31,32, respectively, in the first yarn stretch region 60 by the combined action of the larger roll 32 and the greater speed of the larger roll 32. It will be appreciated by those skilled in the art that, as an option, either the larger drive roll method or the increased speed method may be used to achieve stretching in the yarn stretch regions. After the yarn exits the first yarn stretch region 60 and comes off the first drive roll 32 it enters the first yarn relaxation region 62 intermediate the stretching assemblies 30,40. From there, it is directed back up into the second yarn stretching assembly 40 by incidental contact with yarn guide peg 39. Stretching action similar to the first stretching action occurs in the second stretching region 64 and similar relaxation occurs in the second relaxation region 67. Since the yarn strand 15 actually elongates as it is stretched and relaxed, the second yarn stretching assembly 40 is driven at a slightly faster rate than the first yarn stretching assembly 30. Similarly, the third yarn stretching assembly 50 is driven at a slightly faster rate than the second yarn stretching assembly to compensate for the increased length of the yarn strand 15 as it is stretched and relaxed. As stated before, the yield component of the yarn is increased and, therefore, the yarn may extend farther prior to permanent deformation.

According to the method of the present invention and with reference to FIG. 1, the yarn is threaded up through the winder 10, and the winder motors are engaged to commence winding operations. As the yarn leaves the second bearing 22 of the support assembly 14, it enters the three yarn stretching assemblies where it is stretched three times in a manner previously discussed. It will be appreciated that partial effects may be achieved by using only two stretches and a two stretching assembly which, while illustrated diagrammatically in FIG. 3, is achieved through the omission of the third stretching assembly 50. Some benefits are to be realized by stretching the yarn twice as opposed to three times but it will be appreciated by those experienced in the art that the third stretch is necessary to achieve complete stabilization of the yarn.

By the above, it has been demonstrated that by stretching natural rubber yarn three times it can be stabilized. The present invention provides a method and apparatus for accomplishing this in conjunction with a yarn winding operation providing a convenient and thorough method for achieving wound yarn packages of natural rubber yarn which are ready for use and which are superior to yarn packages which have not been through the stretching process as described.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A method for stabilizing and increasing the yield of natural rubber yarn prior to winding the yarn on a bobbin, the method comprising the steps of:

providing a traveling strand of natural rubber yarn for winding on a bobbin;

providing means for winding the strand on a bobbin;

providing first means for stretching the yarn, said first stretching means being associated with said winding means;

providing second means for stretching the yarn, said second stretching means spaced a predetermined distance from said first stretching means, with the space therebetween defining a first yarn relaxation region, with a space downstream of said second stretching means defining a second relaxation region;

stretching the traveling yarn using said first stretching means;

relaxing the yarn in said first relaxation region;

stretching the yarn a second time using said second stretching means;

relaxing the yarn in said second relaxation region, and winding the yarn on a bobbin using said yarn winding means.

2. A method for stabilizing and increasing the yield of natural rubber yarn according to claim 1 and further comprising the steps of:

providing third means for stretching the yarn, said third stretching means being disposed intermediate the second stretching means and said winding means and being spaced a predetermined distance from said second stretching means with the space therebetween defining said second relaxation region, and a space between said third stretching means and said winding means defining a third relaxation region;

stretching the yarn using said third stretching means; and relaxing the yarn in said third relaxation region.

3. A method for stabilizing and increasing the yield of natural rubber yarn according to claim 1 wherein the step of providing first stretching means includes providing a plurality of rolls forming two nips with the yarn directed to pass between said nips and the step of stretching said yarn a first time includes passing the yarn between said nips.

4. A method for stabilizing and increasing the yield of natural rubber yarn according to claim 3 wherein the step of providing a plurality of rolls includes providing two yarn drive rolls formed with diameters different from one another, with one yarn drive roll being used to form one of said two nips, and the other yarn drive roll being used to form the other of said two nips, so that yarn passing through said one of said nips travels faster than yarn traveling through the other of said two nips.

5. A method for stabilizing and increasing the yield of natural rubber yarn according to claim 3 wherein the step of providing first stretching means includes providing a plurality of rolls, with at least two said rolls being yarn drive rolls, and the other of said rolls being disposed for selective contact with said yarn drive rolls to form at least two nips therebetween, said first stretching means further including means for driving each of said yarn drive rolls at a different speed than the other of said yarn drive rolls so that yarn passing through one of the nips travels faster than yarn passing through the other of said nips.

6. A method for stabilizing and increasing the yield of natural rubber yarn according to claim 3 wherein the step of providing first stretching means includes providing two yarn drive rolls formed with diameters different from one another, with one yarn drive roll being used to form one of said two nips, and the other yarn drive roll being used to form the other of said two nips, so that yarn passing through said one of said nips travels faster than yarn traveling through the other of said two nips and said first stretching means further including means for driving each of said yarn drive rolls at a different speed than the other of said yarn drive rolls so that yarn passing through one of the nips travels faster than yarn passing through the other of said nips.

7. A method for stabilizing and increasing the yield of natural rubber yarn according to claim 1 wherein the step of providing said second stretching means includes providing a plurality of rolls forming two nips with the yarn directed to pass between said nips and the step of stretching said yarn a second time includes passing the yarn between the nips.

8. A method for stabilizing and increasing the yield of natural rubber yarn according to claim 7 wherein the step of providing a plurality of rolls includes providing two yarn drive rolls formed with diameters different from one another, with one yarn drive roll being used to form one of said two nips, and the other yarn drive roll being used to form the other of said two nips, so that yarn passing through said one of said nips travels faster than yarn traveling through the other of said two nips.

9. A method for stabilizing and increasing the yield of natural rubber yarn according to claim 8 wherein the step of providing second stretching means includes providing a plurality of rolls, with at least two said rolls being yarn drive rolls, and the other of said rolls being disposed for selective contact with said yarn drive rolls to form at least two nips therebetween, said second stretching means further including means for driving each of said yarn drive rolls at a different speed than the other of said yarn drive rolls so that yarn passing through one of the nips travels faster than yarn passing through the other of said nips.

10. A method for stabilizing and increasing the yield of natural rubber yarn according to claim 7 wherein the step of providing second stretching means includes providing two yarn drive rolls formed with diameters different from one another, with one yarn drive roll being used to form one of said two nips, and the other yarn drive roll being used to form the other of said two nips, so that yarn passing through said one of said nips travels faster than yarn traveling through the other of said two nips and said second stretching means further including means for driving each of said yarn drive rolls at a different speed than the other of said yarn drive rolls so that yarn passing through one of the nips travels faster than yarn passing through the other of said nips.

11. A method for stabilizing and increasing the yield of natural rubber yarn according to claim 2 wherein the step of providing said third stretching means includes providing a plurality of rolls forming two nips with the yarn directed to pass between said nips and the step of stretching said yarn a third time includes passing the yarn between the nips.

12. A method for stabilizing and increasing the yield of natural rubber yarn according to claim 11 wherein the step of providing a plurality of rolls includes providing two yarn drive rolls formed with diameters different from one another, with one yarn drive roll being used to form one of said two nips, and the other yarn drive roll being used to form the other of said two nips, so that yarn passing through said one of said nips travels faster than yarn traveling through the other of said two nips.

13. A method for stabilizing and increasing the yield of natural rubber yarn according to claim 11 wherein the step of providing third stretching means includes providing a plurality of rolls, with at least two said rolls being yarn drive rolls, and the other of said rolls being disposed for selective contact with said yarn drive rolls to form at least two nips therebetween, said third stretching means further including means for driving each of said yarn drive rolls at a different speed than the other of said yarn drive rolls so that yarn passing through one of the nips travels faster than yarn passing through the other of said nips.

14. A method for stabilizing and increasing the yield of natural rubber yarn according to claim 11 wherein the step of providing third stretching means includes providing two yarn drive rolls formed with diameters different from one another, with one yarn drive roll being used to form one of said two nips, and the other yarn drive roll being used to form the other of said two nips, so that yarn passing through said one of said nips travels faster than yarn traveling through the other of said two nips and said third stretching means further including means for driving each of said yarn drive rolls at a different speed than the other of said yarn drive rolls so that yarn passing through one of the nips travels faster than yarn passing through the other of said nips.

15. An apparatus for stabilizing and increasing the yield of a traveling strand of natural rubber yarn prior to winding the yarn on a bobbin, the apparatus comprising:

means for winding the strand on a bobbin;

first means for stretching the yarn, said first stretching means being associated with said winding means; and second means for stretching the yarn, said second stretching means spaced a predetermined distance from said first stretching means, with the space therebetween defining a first yarn relaxation region, with a space downstream of said second stretching means defining a second relaxation region.

16. An apparatus for stabilizing and increasing the yield of a traveling strand of natural rubber yarn according to claim 15 and further comprising:

third means for stretching the yarn, said third stretching means being disposed intermediate the second stretching means and said winding means and being spaced a predetermined distance from said second stretching means with the space therebetween defining a second relaxation region, and a space between said third stretching means and said winding means defining a third relaxation region.

17. An apparatus for stabilizing and increasing the yield of natural rubber yarn according to claim 15 wherein the plurality of rolls two yarn drive rolls formed with diameters different from one another, with one yarn drive roll being used to form one of said two nips, and the other yarn drive roll being used to form the other of said two nips, so that yarn passing through said one of said nips travels faster than yarn traveling through the other of said two nips.

18. An apparatus for stabilizing and increasing the yield of natural rubber yarn according to claim 15 wherein first stretching means includes a plurality of rolls, with at least two said rolls being yarn drive rolls, and the other of said rolls being disposed for selective contact with said yarn drive rolls to form at least two nips therebetween, said first stretching means further including means for driving each of said yarn drive rolls at a different speed than the other of said yarn drive rolls so that yarn passing through one of the nips travels faster than yarn passing through the other of said nips.

19. An apparatus for stabilizing and increasing the yield of natural rubber yarn according to claim 18 wherein said first stretching means includes two yarn drive rolls formed with diameters different from one another, with one yarn drive roll being used to form one of said two nips, and the other yarn drive roll being used to form the other of said two nips, so that yarn passing through said one of said nips travels faster than yarn traveling through the other of said two nips and said first stretching means further including means for driving each of said yarn drive rolls at a different speed than the other of said yarn drive rolls so that yarn passing through one of the nips travels faster than yarn passing through the other of said nips.

20. An apparatus for stabilizing and increasing the yield of natural rubber yarn according to claim 15 wherein said second stretching means includes a plurality of rolls forming two nips with the yarn directed to pass between said nips.

21. An apparatus for stabilizing and increasing the yield of natural rubber yarn according to claim 20 wherein said plurality of rolls includes two yarn drive rolls formed with diameters different from one another, with one yarn drive roll being used to form one of said two nips, and the other yarn drive roll being used to form the other of said two nips, so that yarn passing through said one of said nips travels faster than yarn traveling through the other of said two nips.

22. An apparatus for stabilizing and increasing the yield of natural rubber yarn according to claim 21 wherein said second stretching means includes a plurality of rolls, with at least two said rolls being yarn drive rolls, and the other of said rolls being disposed for selective contact with said yarn drive rolls to form at least two nips therebetween, said second stretching means further including means for driving each of said yarn drive rolls at a different speed than the other of said yarn drive rolls so that yarn passing through one of the nips travels faster than yarn passing through the other of said nips.

23. An apparatus for stabilizing and increasing the yield of natural rubber yarn according to claim 21 wherein said second stretching means includes two yarn drive rolls formed with diameters different from one another, with one yarn drive roll being used to form one of said two nips, and the other yarn drive roll being used to form the other of said two nips, so that yarn passing through said one of said nips travels faster than yarn traveling through the other of said two nips and said second stretching means further including means for driving each of said yarn drive rolls at a different speed than the other of said yarn drive rolls so that yarn passing through one of the nips travels faster than yarn passing through the other of said nips.

24. An apparatus for stabilizing and increasing the yield of natural rubber yarn according to claim 16 wherein said third stretching means includes a plurality of rolls forming two nips with the yarn directed to pass between said nips and the step of stretching said yarn a third time includes passing the yarn between the nips.

25. An apparatus for stabilizing and increasing the yield of natural rubber yarn according to claim 24 wherein said plurality of rolls includes two yarn drive rolls formed with diameters different from one another, with one yarn drive roll being used to form one of said two nips, and the other yarn drive roll being used to form the other of said two nips, so that yarn passing through said one of said nips travels faster than yarn traveling through the other of said two nips.

26. An apparatus for stabilizing and increasing the yield of natural rubber yarn according to claim 24 wherein said third stretching means includes a plurality of rolls, with at least two said rolls being yarn drive rolls, and the other of said rolls being disposed for selective contact with said yarn drive rolls to form at least two nips therebetween, said third stretching means further including means for driving each of said yarn drive rolls at a different speed than the other of said yarn drive rolls so that yarn passing through one of the nips travels faster than yarn passing through the other of said nips.

27. An apparatus for stabilizing and increasing the yield of natural rubber yarn according to claim 16 wherein said third stretching means includes two yarn drive rolls formed with diameters different from one another, with one yarn drive roll being used to form one of said two nips, and the other yarn drive roll being used to form the other of said two nips, so that yarn passing through said one of said nips travels faster than yarn traveling through the other of said two nips and said third stretching means furlher including means for driving each of said yarn drive rolls at a different speed than the other of said yarn drive rolls so that yarn passing through one of the nips travels faster than yarn passing through the other of said nips.

* * * * *

UNITED STATES PATENT AND TRADEMARK OFFICE

CERTIFICATE OF CORRECTION

PATENT NO. : 5,644,825

DATED : July 8, 1997

INVENTOR(S) : James O. Threlkeld, et al.

It is certified that error appears in the above-identified patent and that said Letters Patent is hereby corrected as shown below:

Column 1, line 8, after "apparatus", insert -- for --

Column 1, line 9, after "yarn", delete "for"

Column 1, line 16, after "tendency", delete "to"

Column 1, line 40, after "plurality" insert -- of --

Column 1, line 44, after "and", delete "releasing" and insert therefor -- relaxing --

Column 2, line 1, before "third" insert -- the --

Column 2, line 19, delete "in" and insert -- and --

Column 2, line 67, delete "yard" and insert -- yarn --

Column 4, line 24, after "26" insert -- 26. --

Column 4, line 63, delete "have" and insert -- having --

Column 8, line 57, at the beginning of the line insert -- second stretching means includes a --, and after "of rolls" insert -- comprising --

UNITED STATES PATENT AND TRADEMARK OFFICE

CERTIFICATE OF CORRECTION

PATENT NO. : 5,644,825

DATED : July 8, 1997

INVENTOR(S) : James O. Threlkeld, et al.

It is certified that error appears in the above-identified patent and that said Letters Patent is hereby corrected as shown below:

Column 10, line 42, delete "fulher" and insert -- further --

Signed and Sealed this

Twenty-second Day of December, 1998

*Attest:*

Bruce Lehman

BRUCE LEHMAN

*Attesting Officer*

*Commissioner of Patents and Trademarks*